US007148627B2

(12) United States Patent
Ishii et al.

(10) Patent No.: US 7,148,627 B2
(45) Date of Patent: Dec. 12, 2006

(54) MAGNETRON

(75) Inventors: Takeshi Ishii, Oyama (JP); Etsuo Saitou, Tochigi (JP); Masanori Yoshihara, Imaichi (JP); Toshiyuki Tsukada, Utsunomiya (JP); Hideki Ohguri, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 436 days.

(21) Appl. No.: 10/601,462

(22) Filed: Jun. 23, 2003

(65) Prior Publication Data

US 2004/0021422 A1 Feb. 5, 2004

(30) Foreign Application Priority Data

Jul. 31, 2002 (JP) ..... 2002-222781

(51) Int. Cl.
*H01J 25/50* (2006.01)

(52) U.S. Cl. ..... 315/39.51

(58) Field of Classification Search ..... 315/39.51, 315/39.53, 39.67, 39.71
See application file for complete search history.

(56) References Cited

U.S. PATENT DOCUMENTS 4,169,987 A * 10/1979 Oguro et al. ..... 315/39.51
5,177,403 A * 1/1993 Kawaguchi et al. ..... 315/39.71
5,180,946 A * 1/1993 Aiga et al. ..... 315/39.51
6,097,154 A * 8/2000 Choi ..... 315/39.51

FOREIGN PATENT DOCUMENTS

| | | | |
|---|---|---|---|
| JP | 62-17973 | Y2 | 5/1987 |
| JP | 02078133 | A | 3/1990 |
| JP | 09293457 | A | 11/1997 |
| JP | 11025870 | A | 1/1999 |
| JP | 2000164151 | A | 6/2000 |
| JP | 2001155651 | A | 6/2001 |
| KR | 1999-014032 | | 4/1999 |

* cited by examiner

*Primary Examiner*—Tuyet Vo
*Assistant Examiner*—Ephram Alemu
(74) *Attorney, Agent, or Firm*—Akin Gump Strauss Hauer & Feld, LLP

(57) ABSTRACT

A magnetron is configured so that an antenna lead 17 connected to a desired position of an anode segment 2 passes through a magnetic pole piece 7 and a metal cylinder 8 so as not to make contact therewith and is connected to the output portion of the magnetron, and so that the electrical length L1 of this antenna lead 17 between the opening end of a third harmonic restraint choke 15 and the connection portion of the anode segment 2 is ½of the wavelength (λ) of the third harmonic, thereby restraining the third harmonic and the side bands of the third harmonic.

3 Claims, 10 Drawing Sheets

MAGNETRON

This application claims the priority of Japanese patent application No. 2002-222781 filed 0n Jul. 31, 2002.

BACKGROUND OF THE INVENTION

The present invention relates to a magnetron for use in microwave ovens and the like, and more particularly to a mechanism for restraining the leakage of harmonic components from the output portion of the magnetron.

Generally, a magnetron for a microwave oven generates a microwave of 2.45 GHz as a fundamental wave. When generating the microwave, the magnetron generates harmonic components having frequencies of integral multiples of the fundamental wave in addition to the fundamental wave, simultaneously. When the harmonic components are radiated from the output portion, just like the fundamental wave, the harmonics are propagated into the microwave oven. Since the wavelengths of the harmonics are short, when they are propagated once into the microwave oven, it is difficult to prevent their leakage to the outside of the microwave oven. Since leakage power leaked to the outside of the microwave oven may cause wireless communication failures, the limit of the leakage is controlled by law in Japan.

Hence, in order to restrain harmonic components from generating from a magnetron itself inside a microwave oven, a magnetron provided with a quarter-wave choke at its output portion for outputting a microwave is generally used.

This kind of conventional magnetron will be described below referring to the accompanying drawings.

FIG. 10 is a sectional view showing the main portion of the conventional magnetron. FIG. 11 is a graph showing the noise levels of respective harmonics in a microwave oven in which the conventional magnetron is used. FIG. 12 is a graph showing an example wherein the noise levels in the frequency bands in the vicinity of a third harmonic leaked from the microwave oven in which the conventional magnetron is used is plotted in narrow ranges. In FIG. 11 and FIG. 12, the vertical axis represents noise level [dBpW], and the horizontal axis represents oscillation frequency [GHz].

As shown in FIG. 10, a plurality of anode segments 102 are secured to the inner wall of an anode cylinder 101, and these anode segments 102 are disposed so as to be directed toward the central axis of the anode cylinder 101. Inside the anode cylinder 101, a cathode 105 is disposed along the central axis thereof, and each of the upper and lower ends of the cathode 105 is secured to an end hat 106. The upper and lower ends of the respective anode segments 102 are connected alternately via a pair of large and small strap rings 103 and 104, respectively. At the upper and lower opening ends of the anode cylinder 101 having a cylindrical shape, metal cylinders 108 are heretically sealed via magnetic pole pieces 107.

In the upper portion inside the metal cylinder 108, that is, on the output side, a cylindrical choke 109 for restraining the third harmonic and a cylindrical choke 110 for restraining the fifth harmonic are disposed substantially coaxially. As shown in FIG. 10, one end of an antenna lead 113 is secured to one of the anode segments 102. This antenna lead 113 passes through the magnetic pole piece 107 and extends upward inside the metal cylinder 108 along the central axis thereof. The antenna lead 113 passes through the inside of the metal cylinder 108 and passes through an output portion 120 comprising a ceramic cylinder 111 and an exhaust pipe 112 so as not to make contact with the inner face thereof.

The end of the antenna lead 113 is crimped and secured to the output portion 120 together with the exhaust pipe 112.

By using the conventional magnetron configured as described above for a microwave oven, the level of noise leaking from the microwave oven was measured. As shown in FIG. 11, among the noise levels of the respective harmonics of the fundamental wave (2.45 GHz), the level of the third harmonic, a 7.35 GHz band, was higher than the levels of the other harmonics.

FIG. 12 is a graph showing a result wherein the noise level of the third harmonic leaked from the microwave oven in which the conventional magnetron is used is plotted in narrow ranges. As shown in FIG. 12, in the vicinity of the third harmonic, the levels in a low side band of 6.9±0.15 GHz and a high side band of 8.3±0.15 GHz were high. More specifically, the noise level was about 80 dBpW at the third harmonic of 7.35 GHz, about 87 dBpW at the low side band of 6.9±0.15 GHz and about 95 dBpW at the high side band of 8.3±0.15 GHz.

As described above, the conventional magnetron had a choke structure to restrain the third and fifth harmonics. However, even when such a magnetron was used for a microwave oven, the restraint of the noise level of the third harmonic was still insufficient in comparison with the other harmonics as shown in the noise level graphs of FIGS. 11 and 12; in particular, in the low side band of 6.9±0.15 GHz and the high side band of 8.3±0.15 GHz in the frequency bands in the vicinity of the third harmonic, the magnetron had a problem of not producing the effect of the harmonic restraint chokes.

BRIEF SUMMARY OF THE INVENTION

The present invention is intended to provide a magnetron capable of solving the problem occurred in the conventional magnetron and capable of securely lowering the noise levels of the third harmonic and the side bands of the third harmonic by using a simple configuration without increasing the number of components.

In order to attain the object, a magnetron in accordance with the present invention comprises:

a cylindrical anode cylinder being open at one of the ends thereof, a metal cylinder hermetically sealed at the opening end of the anode cylinder via a magnetic pole piece, a third harmonic restraint cylindrical choke and a fifth harmonic restraint cylindrical choke disposed coaxially inside the metal cylinder, a plurality of anode segments disposed on the inner face of the anode cylinder so as to be directed toward the central axis thereof, an antenna lead connected to a desired position of the anode segment, an output portion connected to the antenna lead passing through the magnetic pole piece and the metal cylinder so as not to make contact therewith and insulated from the metal cylinder, wherein the metal cylinder and the third harmonic restraint cylindrical choke disposed therein constitute a quarter-wave choke for a third harmonic frequency band, and the third harmonic restraint cylindrical choke and a fifth harmonic restraint cylindrical choke disposed therein constitute a quarter-wave choke for a fifth harmonic frequency band, and the electrical length L1 of the antenna lead from the connection end of the anode segment to the opening end of the third harmonic restraint cylindrical choke is ½ of the wavelength (λ) of the third harmonic. With this configuration, the magnetron in accordance with the present invention can securely restrain the noise level of the third harmonic.

A magnetron in accordance with another aspect of the present invention comprises:

a cylindrical anode cylinder being open at one of the ends thereof, a metal cylinder hermetically sealed at the opening end of the anode cylinder via a magnetic pole piece, a third harmonic restraint cylindrical choke and a fifth harmonic restraint cylindrical choke disposed coaxially inside the metal cylinder, a plurality of anode segments disposed on the inner face of the anode cylinder so as to be directed toward the central axis thereof, an antenna lead connected to a desired position of the anode segment, an output portion connected to the antenna lead passing through the magnetic pole piece and the metal cylinder so as not to make contact therewith and insulated from the metal cylinder, wherein the metal cylinder and the third harmonic restraint cylindrical choke disposed therein constitute a quarter-wave choke for a third harmonic frequency band, and the third harmonic restraint cylindrical choke and the fifth harmonic restraint cylindrical choke disposed therein constitute a quarter-wave choke for a fifth harmonic frequency band, and the third harmonic restraint cylindrical choke is open on the side for introducing the antenna lead connected to the anode segment, a small diameter portion is formed on the opening end side thereof, and a large diameter portion is formed on the output side thereof. With this configuration, the magnetron in accordance with the present invention can further securely restrain the noise level of the third harmonic.

A magnetron in accordance with still another aspect of the present invention comprises:

a cylindrical anode cylinder being open at one of the ends thereof, a metal cylinder hermetically sealed at the opening end of the anode cylinder via a magnetic pole piece, a third harmonic restraint cylindrical choke and a fifth harmonic restraint cylindrical choke disposed coaxially inside the metal cylinder, a plurality of anode segments disposed on the inner face of the anode cylinder so as to be directed toward the central axis thereof, an antenna lead connected to a desired position of the anode segment, an output portion connected to the antenna lead passing through the magnetic pole piece and the metal cylinder so as not to make contact therewith and insulated from the metal cylinder, wherein the metal cylinder and the third harmonic restraint cylindrical choke disposed therein constitute a quarter-wave choke for a third harmonic frequency band, and the third harmonic restraint cylindrical choke and the fifth harmonic restraint cylindrical choke disposed therein constitute a quarter-wave choke for a fifth harmonic frequency band, the electrical length L1 of the antenna lead from the connection end of the anode segment to the opening end of the third harmonic restraint cylindrical choke is ½ of the wavelength (λ) of the third harmonic, and the third harmonic restraint cylindrical choke is open on the side for introducing the antenna lead connected to the anode segment, a small diameter portion is formed on the side of the opening end, and a large diameter portion is formed on the side of the output. With this configuration, the magnetron in accordance with the present invention can securely restrain the noise of both the side bands of the third harmonic.

In addition, in the magnetron in accordance with the present invention, the third harmonic restraint cylindrical choke may be configured so that the dimension of the inside diameter of the small diameter portion thereof is not more than ¼ of the wavelength (λ) of the third harmonic.

Furthermore, in the magnetron in accordance with the present invention, the third harmonic restraint cylindrical choke may be formed so that the step portion between the small diameter portion and the large diameter portion thereof is substantially right-angled.

Moreover, in the magnetron in accordance with the present invention, the third harmonic restraint cylindrical choke may be formed so that the step portion between the small diameter portion and the large diameter portion thereof is inclined.

Still further, in the magnetron in accordance with the present invention, the output portion thereof may be installed on the metal cylinder via a cylindrical insulator and may have an exhaust pipe connected to and held on the cylindrical insulator and a cylindrical portion extended in the direction in parallel with the lead-out direction of the antenna lead inside the exhaust pipe, and the cylindrical portion and the antenna lead may constitute a quarter-wave choke for the low side band of the third harmonic.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the drawings are schematic representations for purposes of illustration and do not necessarily depict the actual relative sizes or locations of the elements shown.

DETAILED DESCRIPTION OF THE INVENTION

Magnetrons in accordance with preferred embodiments of the present invention will be described below in detail referring to the accompanying drawings.

<<First Embodiment>>

Figure 1:
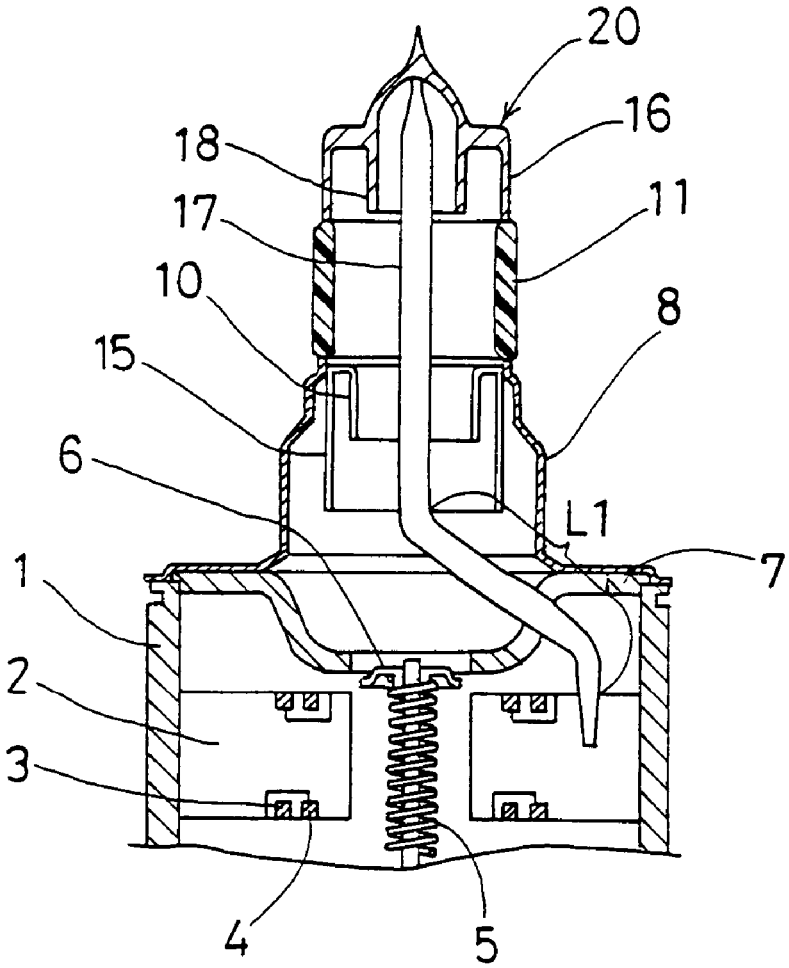
FIG. 1 is a sectional view showing the main portion of a magnetron in accordance with a first embodiment of the present invention.
Figure 2:
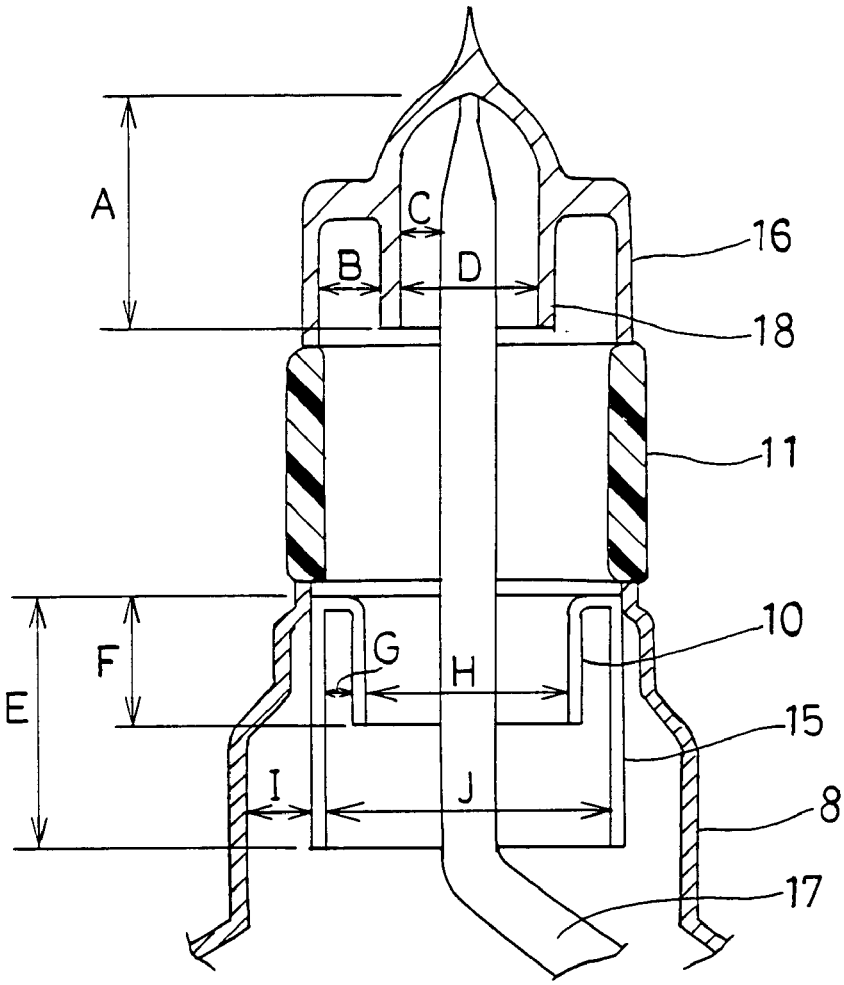
FIG. 2 is a magnified sectional view showing the dimensions of the main portion of the magnetron in accordance with the first embodiment.
Figure 3:
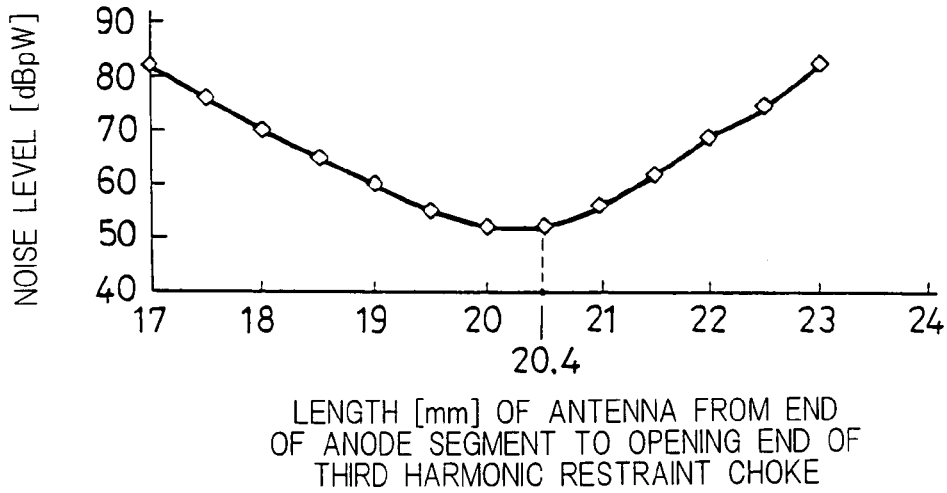
FIG. 3 is a graph showing the relationship between the length of an antenna lead from the end of an anode segment to a third harmonic restraint choke and noise level.
Figure 4:
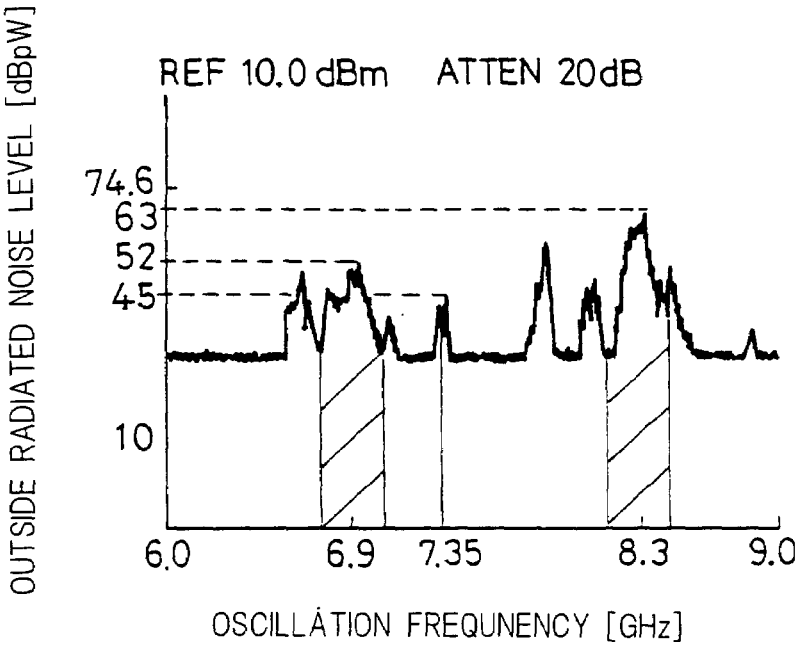
FIG. 4 is a graph showing the noise levels in the frequency bands in the vicinity of the third harmonic in a microwave oven in which the magnetron in accordance with the first embodiment is used.

FIG. 1 is a sectional view showing the main portion of a magnetron in accordance with a first embodiment of the present invention. FIG. 2 is a magnified sectional view showing the dimensions of the main portion of the magnetron in accordance with the first embodiment. FIG. 3 is a graph showing the relationship between the length of an antenna lead from the end of an anode segment to a third harmonic restraint choke and noise level. FIG. 4 is a graph showing, in detail, the noise levels in the frequency bands in the vicinity of the third harmonic in a microwave oven in which the magnetron in accordance with the first embodiment is used.

As shown in FIG. 1, in the magnetron in accordance with the first embodiment, a plurality of plate-formed anode segments 2 are secured to the inner wall of a cylindrical anode cylinder 1, and the anode segments 2 are disposed at equal intervals toward the central axis of the anode cylinder 1. Inside the anode cylinder 1, a cathode 5 is disposed along the central axis thereof in the vertical direction, and each of the upper and lower ends of the cathode 5 is secured to an end hat 6. In FIG. 1, the lower end of the cathode 5 is not shown. The upper and lower ends of the respective anode segments 2 are connected alternately and electrically via a pair of large and small strap rings 3 and 4, respectively. At the upper and lower opening ends of the cylindrical anode cylinder 1, metal cylinders 8 are hermetically sealed via magnetic pole pieces 7.

Inside the metal cylinder 8 sealed at the opening end of the upper portion (the output side) of the anode cylinder 1, in the upper portion thereof, a third harmonic restraint cylindrical choke 15 for restraining the third harmonic and a fifth harmonic restraint cylindrical choke 10 for restraining the fifth harmonic are disposed substantially coaxially. As shown in FIG. 1, one end (the lower end) of an antenna lead 17 is secured to one of the anode segments 2, and the antenna lead 17 passes through the magnetic pole piece 7 and is led out upward inside the metal cylinder 8 along the central axis thereof. Furthermore, the antenna lead 17 passes through the inside of the metal cylinder 8 and passes through an output portion 20 comprising a ceramic cylinder 11 and an exhaust pipe 16 so as not to make contact with the inner face of the side wall thereof. The end of the antenna lead 13 is crimped and secured to the output portion 20 together with the exhaust pipe 16.

As described above, the magnetron in accordance with the first embodiment has a structure wherein microwave energy is delivered from the anode segments 2 via the antenna lead 17. The antenna lead 17 of the magnetron in accordance with the first embodiment is configured so that the electrical length L1 from the end of the anode segment 2 to the end of the third harmonic restraint choke 15 is ½ of the wavelength (λ) of the third harmonic. This electrical length L1 is shown in FIG. 1.

In the magnetron in accordance with the first embodiment configured as described above, the inventors of the present invention confirmed by experiment that the third harmonic component and the side band components of the third harmonic were restrained significantly.

The inventors carried out an experiment on the magnetron in accordance with the first embodiment and analyzed the experiment; the details thereof will be described below.

In the magnetron in accordance with the first embodiment, the metal cylinder 8 and the third harmonic restraint choke 15 disposed therein constitute a quarter-wave choke for the third harmonic and the high side band thereof. Furthermore, the third harmonic restraint choke 15 and the fifth harmonic restraint choke 10 disposed therein constitute a quarter-wave choke for the fifth harmonic and the high side band thereof.

The specific dimensions of the respective quarter-wave chokes of the magnetron in accordance with the first embodiment will be described below by using symbols A to J in the magnified sectional view of FIG. 2.

In the quarter-wave choke for the third harmonic and the high side band thereof, the inside diameter (J) of the third harmonic restraint choke 15 is about 12 mm, the groove depth (E) of this third harmonic restraint choke 15 is 10.2 mm, and the groove width (I) thereof in the radial direction is about 2.8 mm.

Furthermore, in the quarter-wave choke for the fifth harmonic and the high side band thereof, the inside diameter (H) of the fifth harmonic restraint choke 10 is about 9 mm, the groove depth (F) thereof is about 5.3 mm, and the groove width (G) thereof in the radial direction is about 1.5 mm.

In the magnetron in accordance with the first embodiment configured as described above, the fifth harmonic restraint choke 10, the third harmonic restraint choke 15 and the quarter-wave chokes comprising the respective corresponding chokes operate independently for the respective harmonics, carries out the maximum restraining actions on the respective harmonics, thereby producing an excellent restraint effect.

Furthermore, in the magnetron in accordance with the first embodiment, inside the exhaust pipe 16 connected to and held on the upper end of the ceramic cylinder 11, a cylindrical portion 18 extended toward the cathode (in the direction in parallel with the downward lead-out direction of the antenna lead 17) is formed. This cylindrical portion 18 and the antenna lead 17 constitute a quarter-wave choke for the low side band of the third harmonic. In the magnetron in accordance with the first embodiment, the specific dimensions of the quarter-wave choke for the low side band of the third harmonic are as described below; the groove depth (A) is about 10.2 mm, and the groove width (C) in the radial direction is about 1.9 mm. In addition, the inside diameter (D) of the cylindrical portion 18 is 6.0 mm, and the distance (B) between the inner face of the exhaust pipe 16 and the outer face of the cylindrical portion 18 is 2.9 mm. In the magnetron in accordance with the first embodiment, the groove depth (A), the groove width (C) in the radial direction, the inside diameter (D) of the cylindrical portion 18 and the distance (B) between the inner face of the exhaust pipe 16 and the outer face of the cylindrical portion 18, described above, produce an effect of restraining the third harmonic; in particular, the groove depth (A) and the groove width (C) in the radial direction contribute to the restraint of the low side band of the third harmonic.

By using the magnetron in accordance with the first embodiment configured as described above and while variously changing the length L1 of the antenna lead 17 from the end of the anode segment 2 to which the antenna lead 17 was secured to the end of the third harmonic restraint choke 15, the inventors carried out an experiment on the comparison of the outside radiated noise level of the third harmonic depending on the length. The result of the experiment is shown in the graph of FIG. 3. In FIG. 3, the horizontal axis represents the length L1 [mm] of the antenna lead 17, and the vertical axis represents the outside radiated noise level [dBpW].

As clearly shown in FIG. 3, in the magnetron in accordance with the first embodiment of the present invention, the third harmonic was able to be restrained to the lowest when the length L1 of the antenna lead 17 from the end of one of the anode segments 2 to which the antenna lead 17 is connected to the end of the third harmonic restraint choke 15 was about 20.4 mm.

By using the magnetron in accordance with the first embodiment of the present invention configured as described above and the conventional magnetron as magnetrons for microwave ovens provided with oven functions and operating on a fundamental wave oscillation frequency of the 2.45 GHz band and an output power of about 1000 W, the inventors carried out an experiment on the comparison with respect to the radiation level of the third harmonic. In accordance with the measurement method therefor, the microwave oven provided with the magnetron under measurement was set inside an anechoic chamber, a water load was disposed inside this microwave oven, a horn antenna and a measuring instrument for measuring the levels of the respective frequency components of a signal from the horn antenna were connected 3 meters away from the microwave oven, and outside radiated noise levels were measured. The result of this measurement is shown in FIG. 4. FIG. 4 is a graph showing the outside radiated noise levels measured and plotted in narrow ranges in the frequency bands in the vicinity of the third harmonic from the microwave oven in which the magnetron in accordance with the first embodiment is used. In FIG. 4, the horizontal axis represents oscillation frequency [GHz], and the vertical axis represents the outside radiated noise level [dBpW] of the third harmonic.

Figure 12:
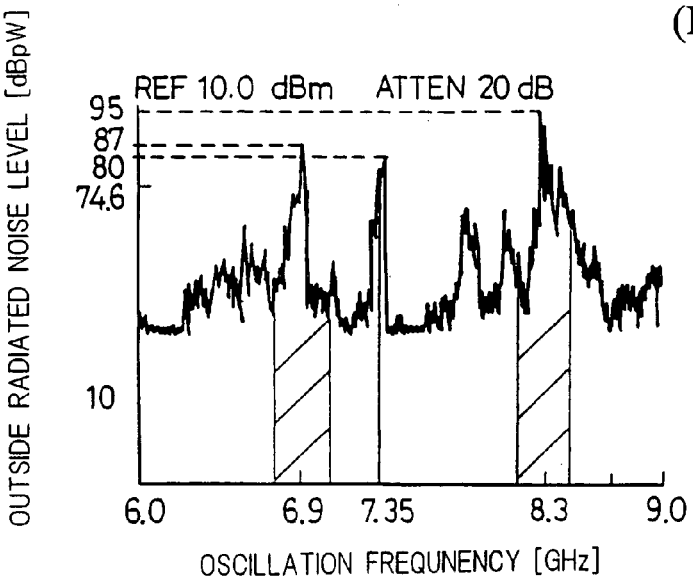
FIG. 12 (PRIOR ART)
FIG. 12 is the graph showing an example wherein the noise levels in the frequency bands in the vicinity of the third harmonic output from the microwave oven in which the conventional magnetron is used is plotted in narrow ranges.

In the case of the microwave oven in which the conventional magnetron is used, as shown in FIG. 12, the noise level was 80 dBpW in the vicinity of 7.35 GHz, triple of the fundamental wave (2.45 GHz); 95 dBpW in the vicinity of 8.3 GHz, the high side band; and 87 dBpW in the vicinity of 6.9 GHz, the low side band.

On the other hand, in the case of the microwave oven in which the magnetron in accordance with the first embodiment of the present invention is used, by setting the electrical length L1 of the antenna lead 17 from the end of the anode segment 2 to the end of the third harmonic restraint choke 15 at ½ of the wavelength (λ) of the third harmonic, the noise level in the vicinity of 7.35 GHz, the third harmonic, was lowered to 45 dBpW; the noise level in the vicinity of 8.3 GHz, the high side band of the third harmonic, was lowered to 63 dBpW by the cylindrical portion of the metal cylinder 8 and the third harmonic restraint choke 15; and the noise level in the vicinity of the low side band of the third harmonic was lowered to 52 dBpW by the exhaust pipe 16 and the antenna lead 17, as shown in FIG. 4.

As described above, the magnetron in accordance with the first embodiment of the present invention can securely restrain the third harmonic without making the configuration of the output portion thereof complicated or larger, whereby it is possible to obtain a magnetron capable of producing an excellent effect practically.

<<Second Embodiment>>

Figure 5:
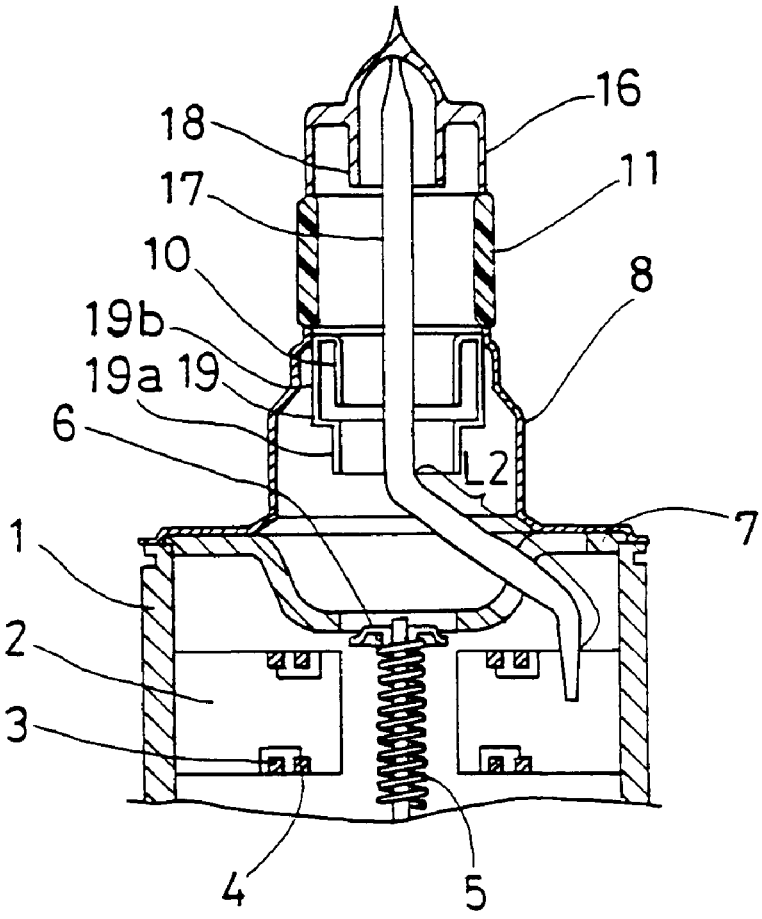
FIG. 5 is a sectional view showing the main portion of a magnetron in accordance with a second embodiment of the present invention.
Figure 6:
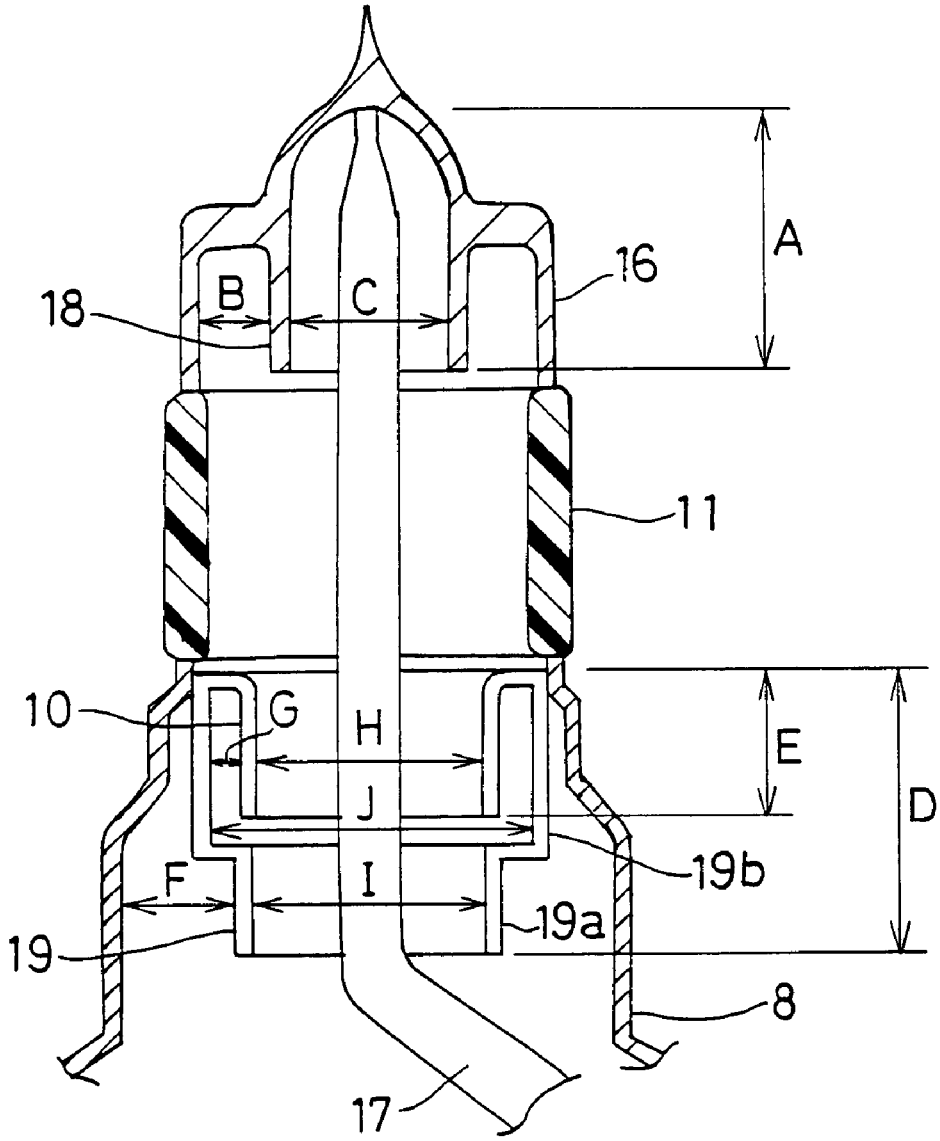
FIG. 6 is a magnified sectional view showing the dimensions of the main portion of the magnetron in accordance with the second embodiment.
Figure 7:
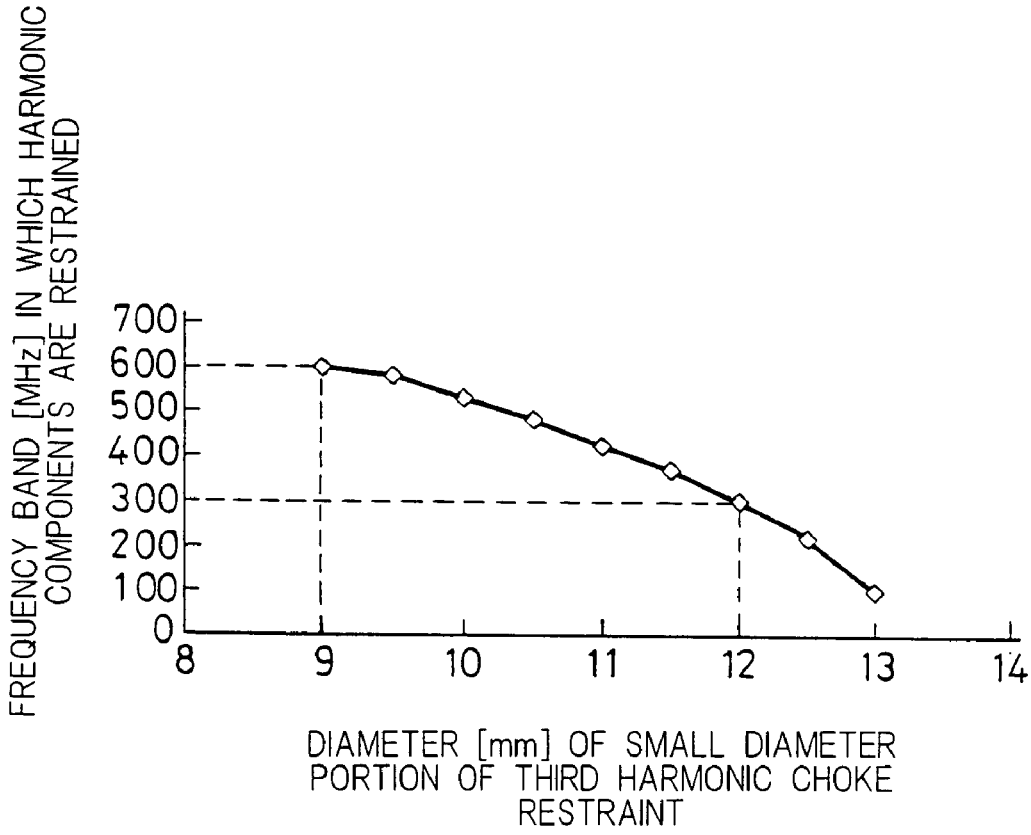
FIG. 7 is a graph showing the relationship between the diameter of the small diameter portion of a third harmonic restraint choke and frequency bands in which restraint is carried out.
Figure 8:
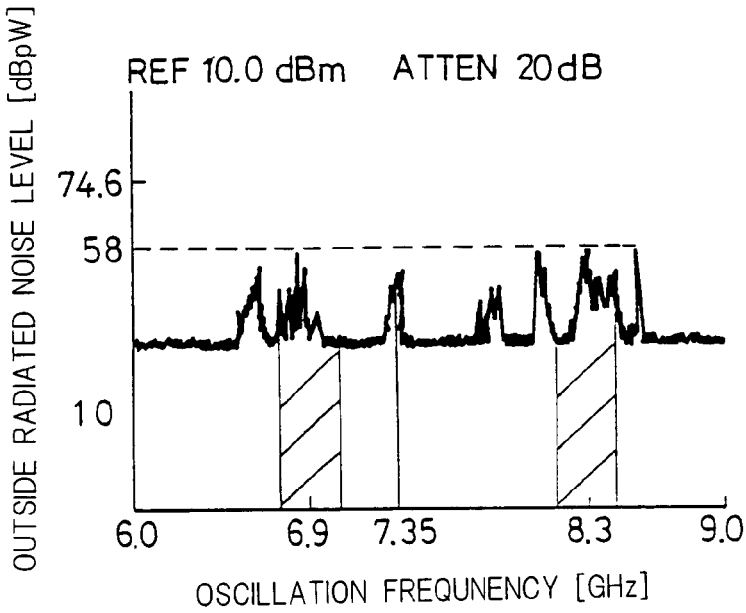
FIG. 8 is a graph showing the noise levels in the frequency bands in the vicinity of the third harmonic in a microwave oven in which the magnetron in accordance with the second embodiment is used.

Next, a magnetron in accordance with a second embodiment of the present invention will be described. FIG. 5 is a sectional view showing the main portion of the magnetron in accordance with the second embodiment of the present invention. FIG. 6 is a magnified sectional view showing the dimensions of the main portion of the magnetron in accordance with the second embodiment. FIG. 7 is a graph showing the relationship between the diameter of the small diameter portion of a third harmonic restraint choke and frequency bands in which restraint is carried out. FIG. 8 is a graph showing the noise levels in the frequency bands in the vicinity of the third harmonic in a microwave oven in which the magnetron in accordance with the second embodiment is used.

As shown in FIG. 5, in the magnetron in accordance with the second embodiment, a third harmonic restraint choke 19 has a large diameter portion 19*b* on the output portion side (the upper side) and has a small diameter portion 19*a* on the cathode side (the lower side), thereby being formed into a cylindrical shape having a step.

In the magnetron in accordance with the second embodiment, its configuration is the same as the configuration of the above-mentioned first embodiment except for the third harmonic restraint choke 19 having the small diameter portion 19*a* and the large diameter portion 19*b*. In other words, the magnetron in accordance with the second embodiment is configured so that the electrical length L2 of the antenna lead 17 from the end of the anode segment 2 to which the antenna lead 17 is secured to the end of the third harmonic restraint choke 19 is ½ of the wavelength (λ) of the third harmonic. This electrical length L2 is shown in FIG. 5.

In the magnetron in accordance with the second embodiment configured as described above, the inventors confirmed by experiment that the third harmonic component and the side band components of the third harmonic were restrained significantly.

The inventors carried out an experiment on the magnetron in accordance with the second embodiment and analyzed the experiment; the details thereof will be described below.

In the magnetron in accordance with the second embodiment, the metal cylinder 8 and the third harmonic restraint choke 19 disposed therein constitute a quarter-wave choke for the third harmonic and the high side band thereof. Furthermore, the third harmonic restraint choke 19 and the fifth harmonic restraint choke 10 disposed therein constitute a quarter-wave choke for the fifth harmonic and the high side band thereof.

The specific dimensions of the respective quarter-wave chokes of the magnetron in accordance with the second embodiment will be described below by using symbols A to J in the magnified sectional view of FIG. 6. FIG. 7 is a graph obtained by measuring restrained harmonic components while fixing the dimension of the large diameter portion 19*b* of the third harmonic restraint choke 19 and changing the diameter of the small diameter portion 19*a*.

The inside diameter (H) of the fifth harmonic restraint choke 10 of the magnetron used in the experiment shown in FIG. 7 is about 9 mm, the groove depth (E) thereof is about 5.3 mm, and the groove width (G) thereof in the radial direction is about 1.5 mm. In addition, in the third harmonic restraint choke 19, the inside diameter (J) of the large diameter portion 19*b* thereof is about 12 mm, and the groove depth (D) of this third harmonic restraint choke is 10.2 mm.

The large diameter portion 19*b* of the third harmonic restraint choke 19 was formed so as to have the above-mentioned dimensions, and comparison was carried out with respect to the outside radiated noise level of the third harmonic in the magnetron while variously changing the diameter of the small diameter portion 19*a*. The result is shown in the graph of FIG. 7.

As clearly shown in FIG. 7, in the magnetron in accordance with the second embodiment of the present invention, it was confirmed that harmonic components were restrained in a wide frequency band of about 600 [MHz] when the inside diameter of the small diameter portion 19*a* was about 9 mm while a distance not causing the danger of discharge was secured between the third harmonic restraint choke 19 and the antenna lead 17.

In the magnetron in accordance with the above-mentioned first embodiment, since the inside diameter of the third harmonic restraint choke 15 is about 12 mm (symbol J of FIG. 2), the harmonic components are restrained in a frequency band of about 300 [MHz] as shown in the graph of FIG. 7. Hence, in the configuration of the magnetron in accordance with the second embodiment, by setting the inside diameter of the small diameter portion 19*a* of the third harmonic restraint choke 19 at about 9 mm (by setting the groove width (F) in the radial direction at about 4.8 mm), it was confirmed that the level of the third harmonic component can be restrained in a wide frequency band of 0.3 GHz or more.

The inventors used the magnetron in accordance with the second embodiment of the present invention configured as described above and the conventional magnetron as magnetrons for microwave ovens provided with oven functions and operating on a fundamental wave oscillation frequency of 2.45 GHz and an output power of about 1000 W, and carried out an experiment on the comparison with respect to the radiation level of the third harmonic. The measurement method therefor is the same as that for the magnetron in accordance with the above-mentioned first embodiment; that is, the microwave oven provided with the magnetron under measurement was set inside an anechoic chamber, a water load was disposed inside this microwave oven, a horn antenna and a measuring instrument for measuring the levels of the respective frequency components of a signal from the horn antenna were connected 3 meters away from the microwave oven, and outside radiated noise levels were measured. The result of this measurement is shown in FIG. 8. FIG. 8 is a graph showing the outside radiated noise levels measured and plotted in narrow ranges in the frequency bands in the vicinity of the third harmonic from the microwave oven in which the magnetron in accordance with the second embodiment is used. In FIG. 8, the horizontal axis represents oscillation frequency [GHz], and the vertical axis represents the outside radiated noise level [dBpW] of the third harmonic.

In the case of the microwave oven in which the conventional magnetron is used, as shown in FIG. 12, the noise level was 80 dBpW in the vicinity of 7.35 GHz, triple of the fundamental wave (2.45 GHz); 95 dBpW in the vicinity of 8.3 GHz, the high side band; and 87 dBpW in the vicinity of 6.9 GHz, the low side band.

As described above, since the third harmonic restraint choke 19 of the magnetron in accordance with the second embodiment of the present invention forms a shape having the large diameter portion 19*b* and the small diameter portion 19*a*, the noise level of the high side band (about 8.3 GHz) of the third harmonic is lowered as shown in the graph of FIG. 8 in comparison with the magnetron in accordance with the first embodiment shown in FIG. 4. Hence, the magnetron in accordance with the second embodiment can restrain the noise level in a wider frequency band.

Figure 9:
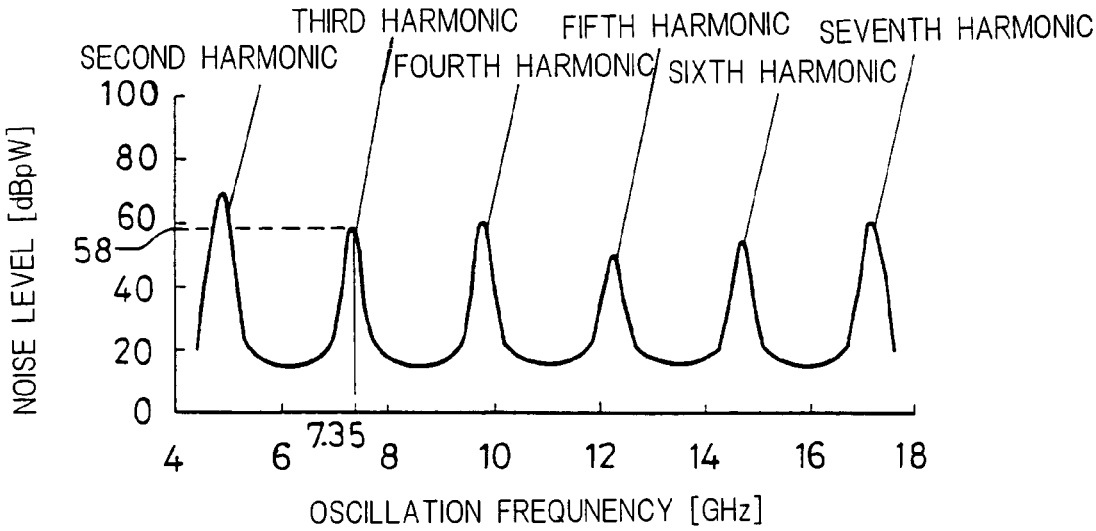
FIG. 9 is a graph showing the noise levels of respective harmonics in the microwave oven in which the magnetron in accordance with the second embodiment is used.
Figure 10:
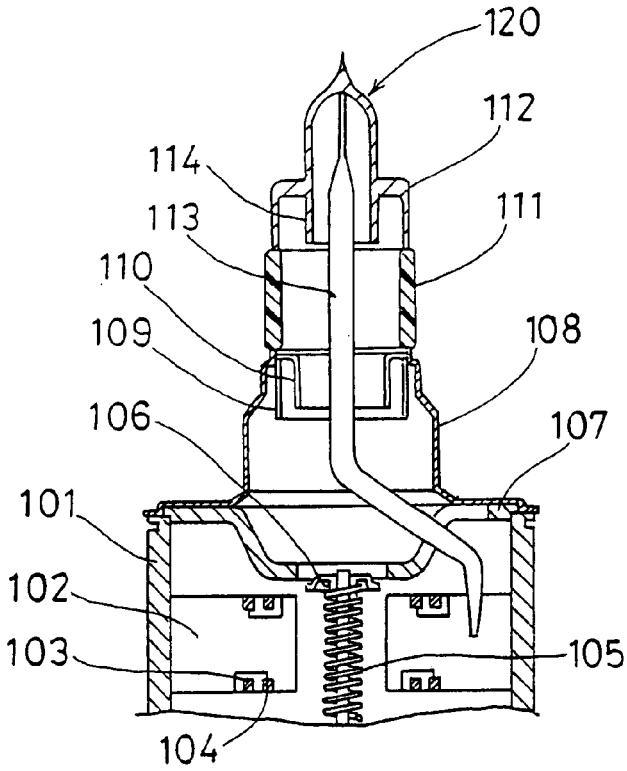
FIG. 10 (PRIOR ART)
FIG. 10 is the sectional view showing the main portion of the conventional magnetron.
Figure 11:
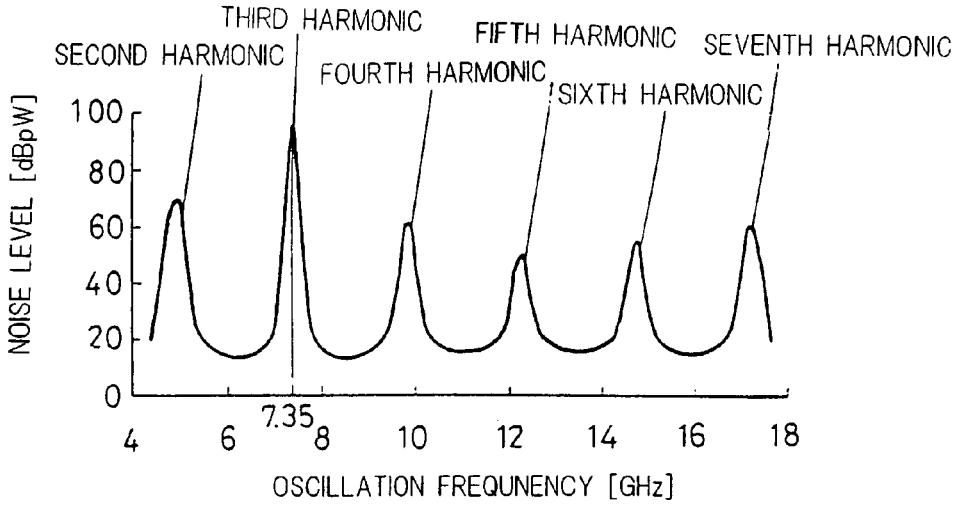
FIG. 11 (PRIOR ART)
FIG. 11 is the graph showing the noise levels of respective harmonics in the microwave oven in which the conventional magnetron is used.

FIG. 9 is a graph showing the noise levels of respective harmonics in the microwave oven in which the magnetron in accordance with the second embodiment is used. As shown in FIG. 9, by using the magnetron in accordance with the second embodiment, it can be confirmed that the noise level of the third harmonic is lowered to about 58 dBpW without affecting the noise restraining effect for harmonics other than the third harmonic.

As described above, the magnetron in accordance with the second embodiment of the present invention can securely restrain the third harmonic without making the configuration of the output portion thereof complicated or larger, whereby it is possible to obtain a magnetron capable of producing an excellent effect practically.

In the magnetron in accordance with the second embodiment, the step portion in the shape having the large diameter portion 19*b* and the small diameter portion 19*a* of the third harmonic restraint choke 19 has a nearly right-angled step shape as shown in FIG. 5; however, the present invention is not limited to this kind of shape; the shape may be a tapered shape.

As clarified by the above-mentioned descriptions, the magnetron in accordance with the present invention produces an excellent effect of capable of securely restraining the third harmonic and the side bands of the third harmonic as well as the fifth harmonic by using a simple and rational configuration without increasing the number of components.

Although the present invention has been described with respect to its preferred embodiments in some detail, the disclosed contents of the preferred embodiments may change in the details of the structure thereof, and any changes in the combination and sequence of the components may be attained without departing from the scope and spirit of the claimed invention.

The invention claimed is:

1. A magnetron comprising: a cylindrical anode cylinder being open at one of the ends thereof, a metal cylinder hermetically sealed at the opening end of said anode cylinder via a magnetic pole piece, a third harmonic restraint cylindrical choke and a fifth harmonic restraint cylindrical choke disposed coaxially inside said metal cylinder, a plurality of anode segments disposed on the inner face of said anode cylinder so as to be directed toward the central axis thereof, an antenna lead connected to a desired position of said anode segment, an output portion connected to said antenna lead passing through said magnetic pole piece and said metal cylinder so as not to make contact therewith and insulated from said metal cylinder, wherein said metal cylinder and said third harmonic restraint cylindrical choke disposed therein constitute a quarter-wave choke for a third harmonic frequency band, and said third harmonic restraint cylindrical choke and a fifth harmonic restraint cylindrical choke disposed therein constitute a quarter-wave choke for a fifth harmonic frequency band, and the electrical length (L1) of said antenna lead from the connection end of said anode segment to the opening end of said third harmonic restraint cylindrical choke is ½ of the wavelength of the third harmonic.

2. A magnetron in accordance with claim 1, wherein said third harmonic restraint cylindrical choke is open on the side for introducing said antenna lead connected to said anode segment, a small diameter portion is formed on the opening end side thereof, and a large diameter portion is formed on the output side thereof.

3. A magnetron in accordance with claim 1 wherein the output portion thereof is installed on said metal cylinder via a cylindrical insulator and has an exhaust pipe connected to and held on said cylindrical insulator and a cylindrical portion extended in the direction in parallel with the lead-out direction of said antenna lead inside said exhaust pipe, and said cylindrical portion and said antenna lead constitute a quarter-wave choke for the low side band of the third harmonic.

* * * * *